US009660383B2

(12) United States Patent
Regnier et al.

(10) Patent No.: US 9,660,383 B2
(45) Date of Patent: May 23, 2017

(54) CONNECTOR WITH TUNED TERMINAL BEAM

(71) Applicant: Molex, LLC, Lisle, IL (US)

(72) Inventors: Kent E. Regnier, Lombard, IL (US); Michael Rowlands, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/105,923

(22) PCT Filed: Dec. 22, 2014

(86) PCT No.: PCT/US2014/071905
§ 371 (c)(1),
(2) Date: Jun. 17, 2016

(87) PCT Pub. No.: WO2015/095869
PCT Pub. Date: Jun. 25, 2015

(65) Prior Publication Data

US 2016/0315419 A1 Oct. 27, 2016

Related U.S. Application Data

(60) Provisional application No. 61/919,278, filed on Dec. 20, 2013.

(51) Int. Cl.
*H01R 13/646* (2011.01)
*H01R 12/72* (2011.01)

(52) U.S. Cl.
CPC ..... *H01R 13/646* (2013.01); *H01R 12/724* (2013.01); *H01R 12/727* (2013.01)

(58) Field of Classification Search
CPC . H01R 23/688; H01R 23/025; H01R 13/6658
USPC ..... 439/607.06, 676, 76.1, 108
See application file for complete search history.

(56) References Cited

U.S. PATENT DOCUMENTS

| | | | | |
|---|---|---|---|---|
| 4,685,886 | A | 8/1987 | Denlinger et al. | |
| 6,120,306 | A | 9/2000 | Evans | |
| 8,540,525 | B2 * | 9/2013 | Regnier | H01R 29/00 439/79 |
| 8,651,881 | B2 * | 2/2014 | Regnier | H01R 29/00 439/108 |
| 8,992,237 | B2 * | 3/2015 | Regnier | H01R 29/00 439/108 |
| 9,054,432 | B2 * | 6/2015 | Yang | H01R 9/24 |
| 9,136,634 | B2 * | 9/2015 | De Geest | H01R 12/724 |
| 2004/0043672 | A1 | 3/2004 | Shuey et al. | |
| 2006/0135003 | A1 | 6/2006 | Peloza | |
| 2011/0212633 | A1 | 9/2011 | Regnier et al. | |

* cited by examiner

*Primary Examiner* — Phuongchi T Nguyen
(74) *Attorney, Agent, or Firm* — Stephen L. Sheldon

(57) ABSTRACT

A connector assembly includes a housing with a card slot and includes terminals positioned in the card slot where the terminals are tuned to improve performance. The terminals include a contact, a tail and a body extending therebetween. The contacts can include a deflecting portion and a pad interface portion. The deflecting portion includes a dual beam portion and a single beam portion. The connector can be configured to provide a row of contacts positioned on both sides of a card slot.

10 Claims, 16 Drawing Sheets

CONNECTOR WITH TUNED TERMINAL BEAM

RELATED APPLICATIONS

This application is a national phase of PCT Application No. PCT/US2014/071905, filed Dec. 20, 2014, which is incorporated herein by reference in its entirety and which claims priority to U.S. Provisional Application No. 61/919,278, filed Dec. 20, 2013.

TECHNICAL FIELD

This disclosure relates to field of connectors, more specifically to connectors intended to be used in higher data rate applications.

DESCRIPTION OF RELATED ART

Connectors are widely used to connect various devices together, either between components within a device or between devices. One type of connector that can be used for both is an input/output (IO) connector. IO connectors are available in a number of configurations but some of the most common IO connectors are provided in configurations intended to comply with standards. For example, the SAS/SATA standard, which is just one of a number of standards, in its various versions defines a number of different IO connector configurations. Each IO connector configuration is intended to fulfill a particular function and therefore different connector configurations are designed so that each intended function can be performed in an efficient and cost effective manner. Internal connectors, for example, tend to be formed of insulative plastic (because there is less need for EMI shielding) and external connectors tend to be formed with a shield (e.g., a cage) surrounding a housing because of the desire for EMI shielding.

As can he appreciated, once a standard with several connector configurations is promulgated, it is desirable to continue to use the same connector configurations in future versions of the standard. This allows for backward compatibility between different versions, even if the older versions cannot support all the features of the new version. Therefore, while a new connector configuration may be added or an old one removed, there is resistance to radically changing the connector configurations. This is, at least in part, because familiarity with the configuration allows the developers of boxes and servers and the like to efficiently design new products based on the same (or similar) physical constraints. A miniSAS HD connector, for example, has four transmit and four receive channels and has a predetermined physical size, thus individuals using this connector would prefer that it he consistent between versions of the SAS standard (e.g., as the SAS standard move from version 2.0 to 3.0 to 4.0). This has created somewhat of an issue, however, as the performance of the next version of a standard will increases compared to the previous version. A given configuration can often accommodate one increase in performance but sometimes the second performance increase will be more problematic. The SAS standard, for example, has a miniSAS HD connector that has gone from 6 Gbps per channel to 12 Gbps per channel in version 3.0 (soon to be released) and version 4.0 is expected to be 20-24 Gbps per channel. Similarly, the PCIe standard is moving to 8 Gbps in Version III and is expected to go to 16 Gbps in Version IV. The increase to around or more than 20+ Gbps creates substantial issues with connector designs as many previously irrelevant details become significant to the design of a successful connector. However, the users of these connectors still desire to have a connector that can work with legacy designs while also supporting the higher data rates. Therefore, certain individuals would appreciate further improvements to a connector system.

SUMMARY

A connector includes a housing with a card slot. The housing supports a plurality of terminals that each have a contact positioned in a card slot. Each of the contacts has a deflecting portion and an interface portion. The deflecting portion includes a dual-beam structure and a single-beam structure.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1A:
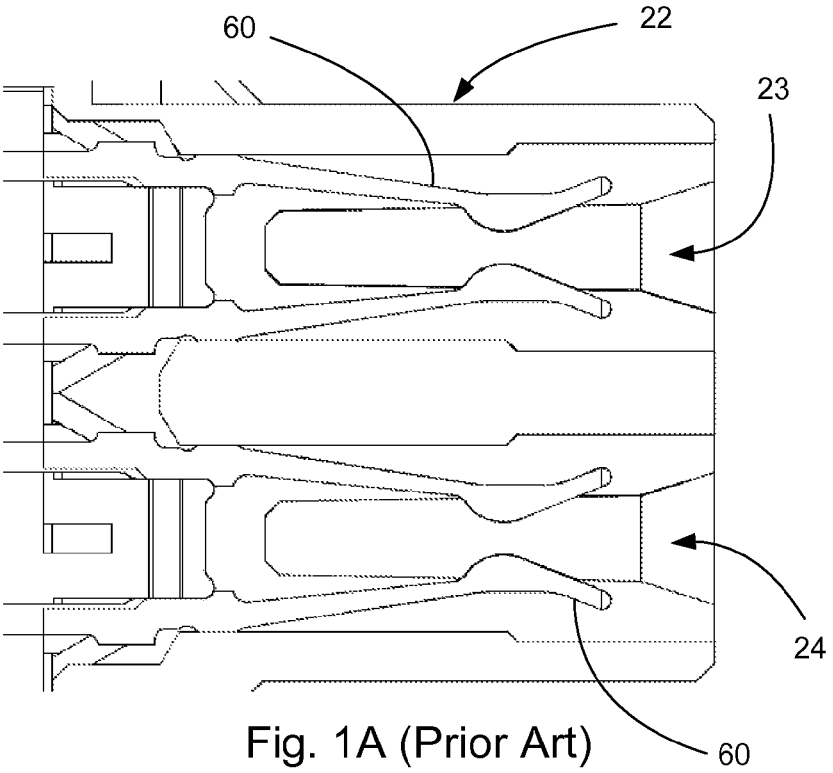
Fig. 1A (Prior Art)
FIG. 1A illustrates a cross-section of an exemplary housing suitable for use as a connector configuration.

As can be appreciated from FIG. 1A, a prior art housing 22 of a connector includes two card slots 23, 24. Contacts 60 are positioned in the card slots 23, 24. While numerous connectors exist, such a construction is similar to what is provided for miniSAS HD style connectors defined in the Serial Attached SCSI (SAS) version 2.1 standard.

Figure 6:
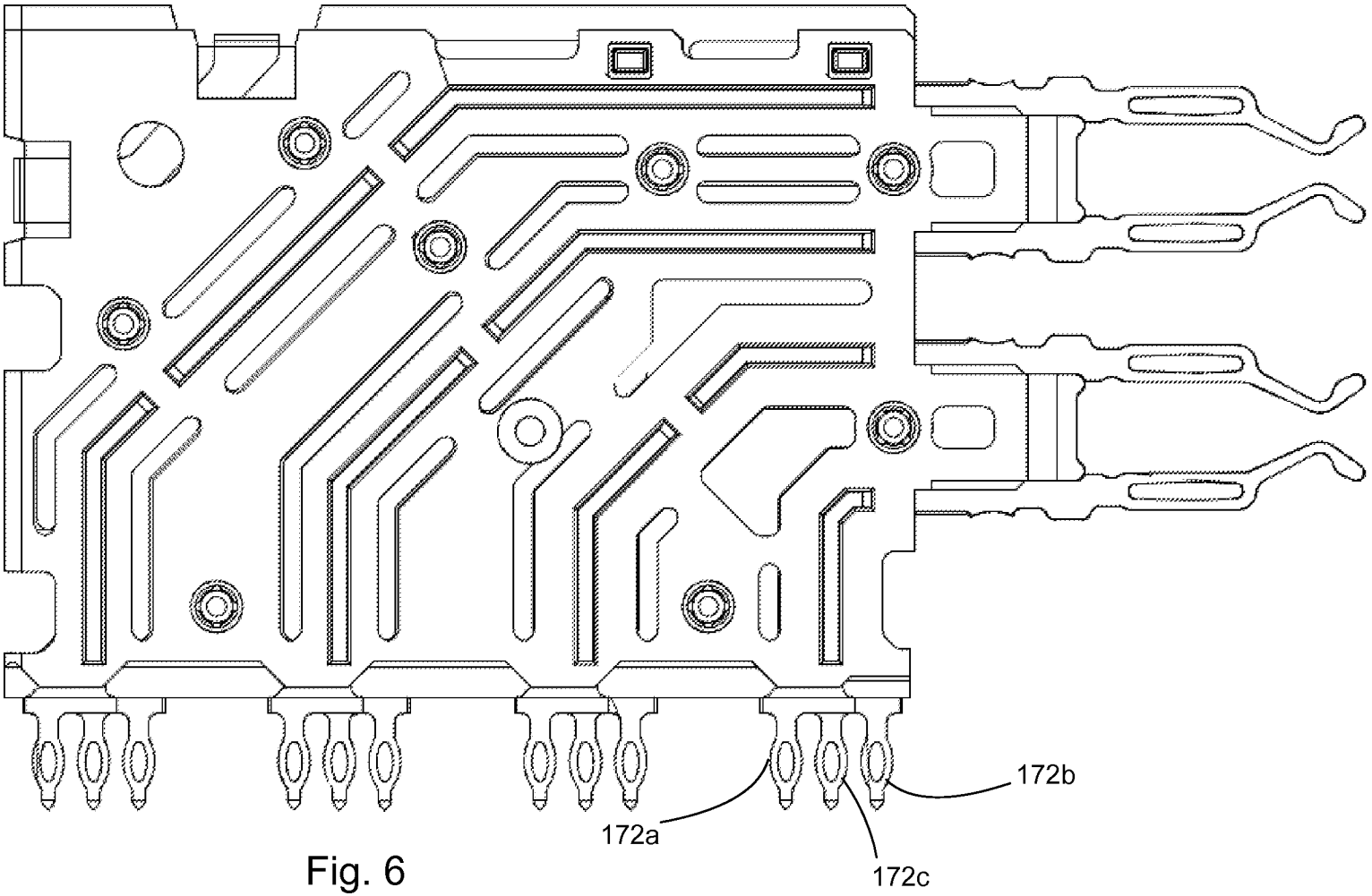
FIG. 6 illustrates an elevated side view of an embodiment of three wafers.
Figure 7:
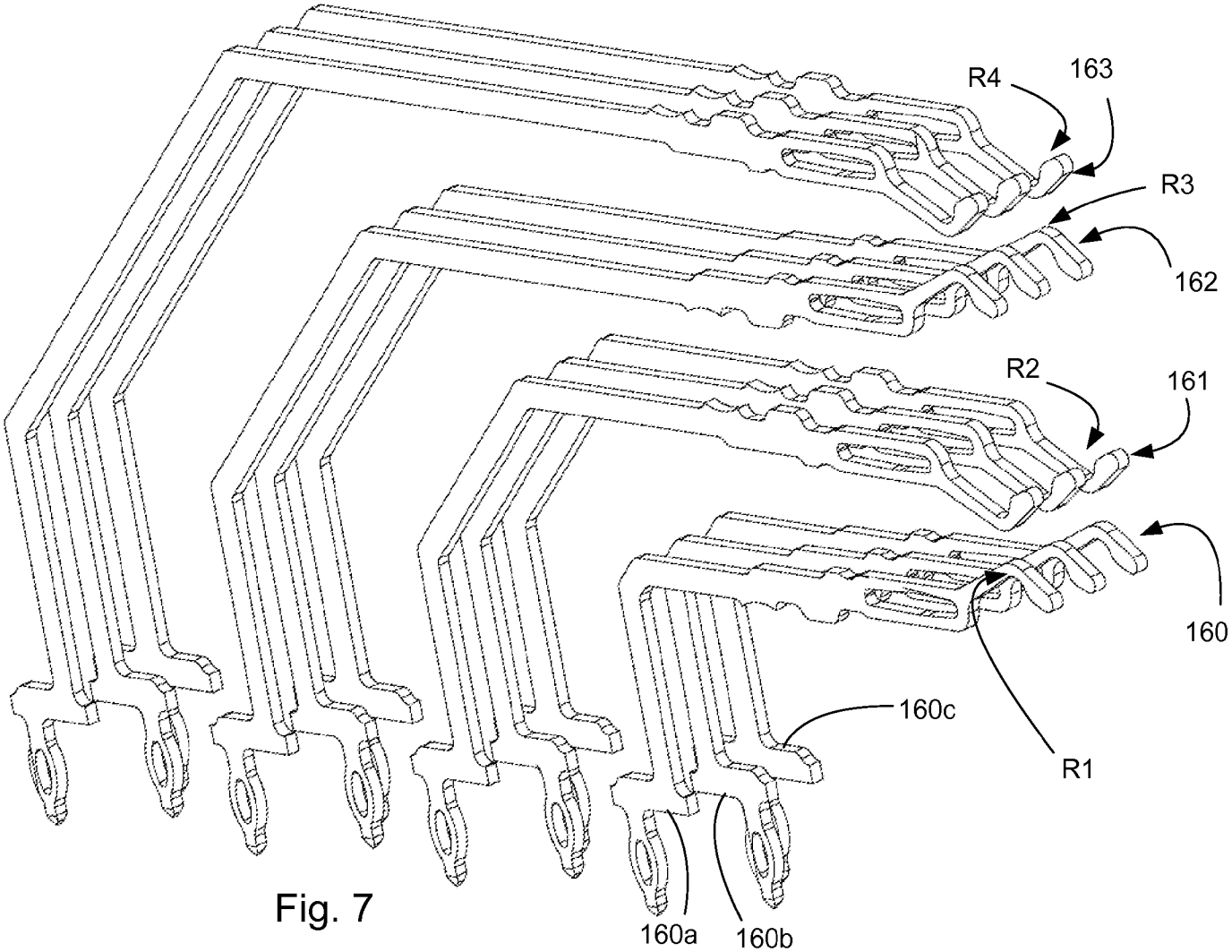
FIG. 7 illustrates a perspective view of the terminals depicted in FIG. 4 with the frame removed.
Figure 8:
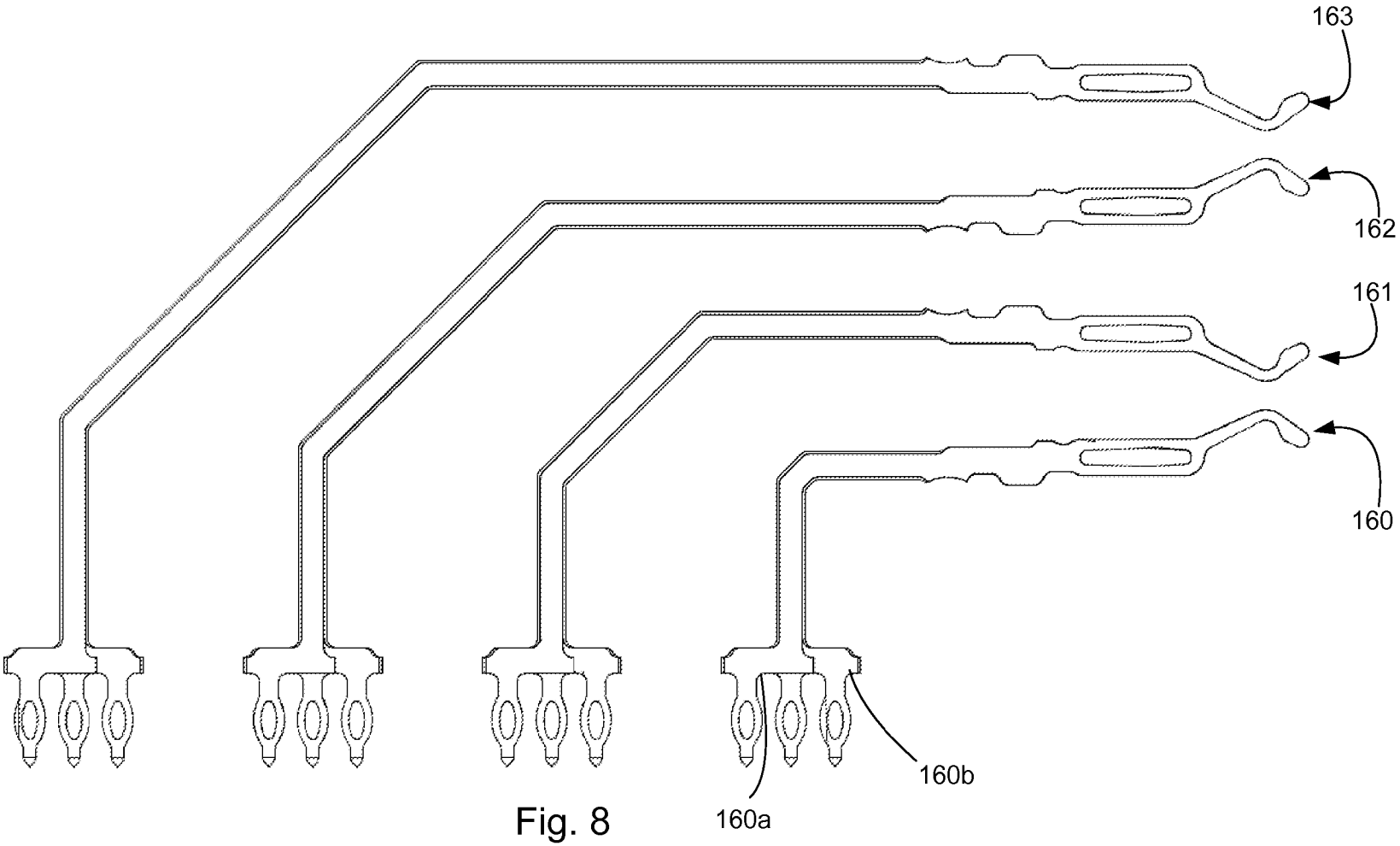
FIG. 8 illustrates an elevated side view of the embodiment depicted in FIG. 7.
Figure 9:
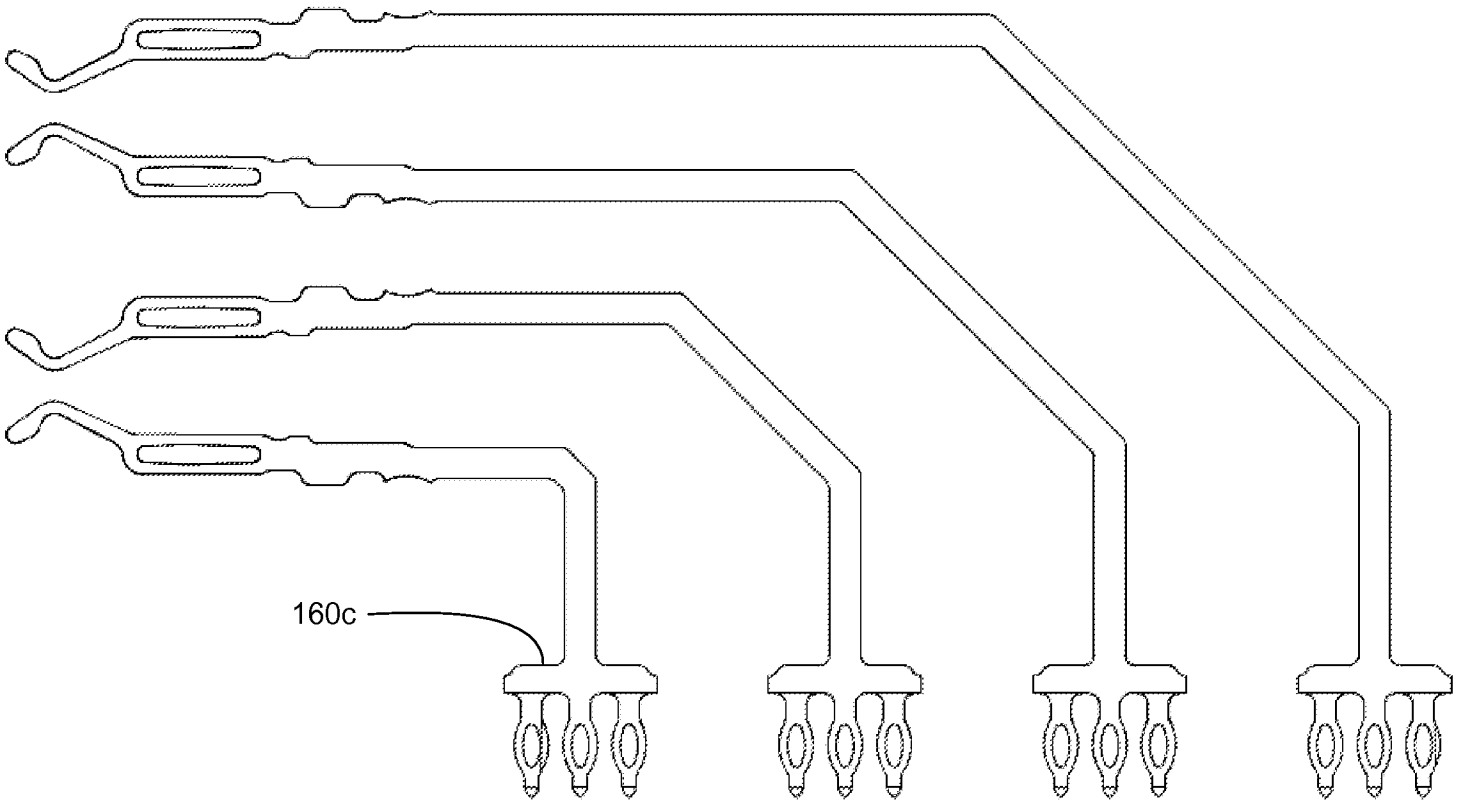
FIG. 9 illustrates another elevated side view of the embodiment depicted in FIG. 7.
Figure 10:
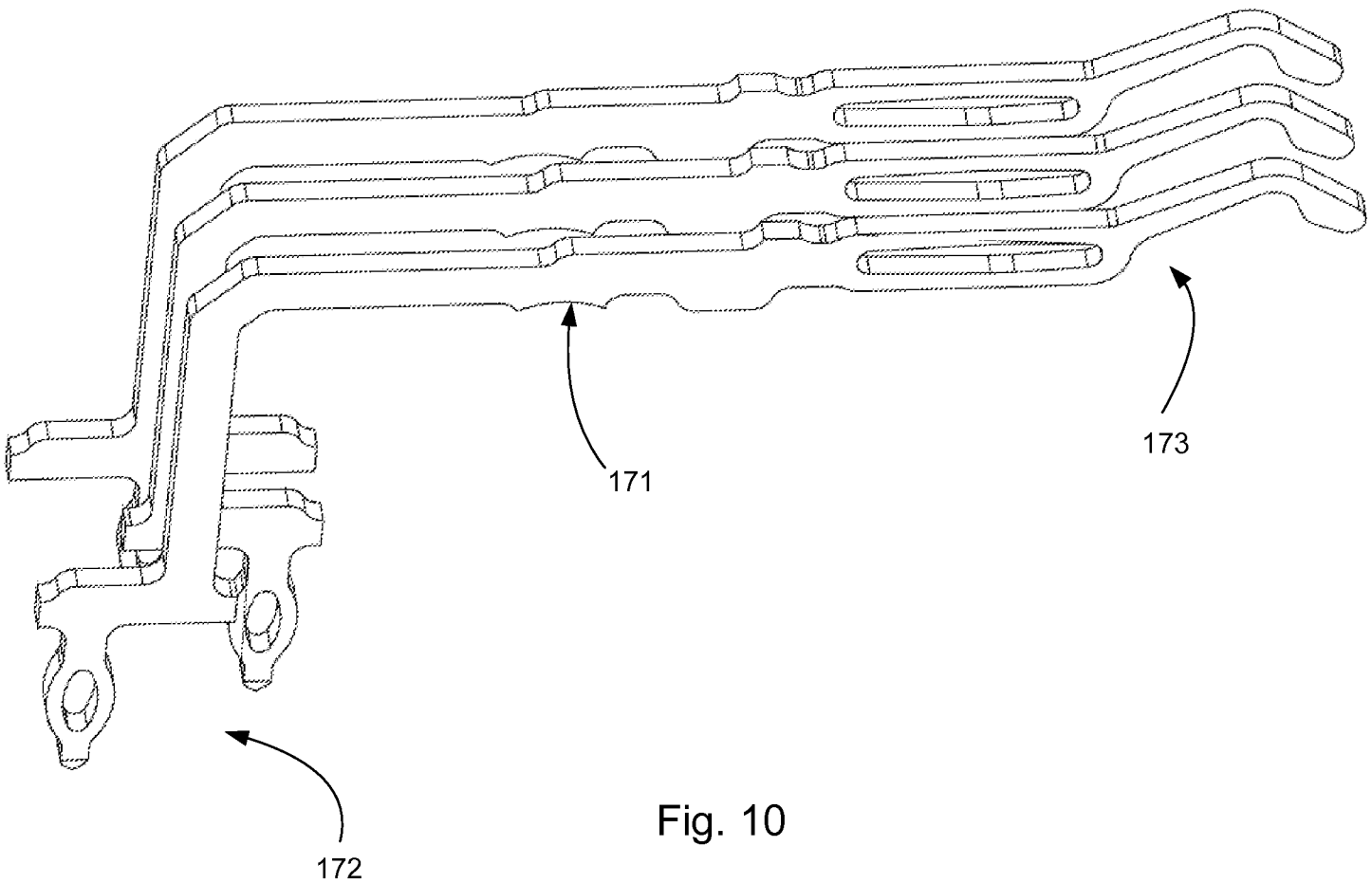
FIG. 10 illustrates a perspective view of an embodiment of three terminals configured to he positioned side by side.
Figure 11:
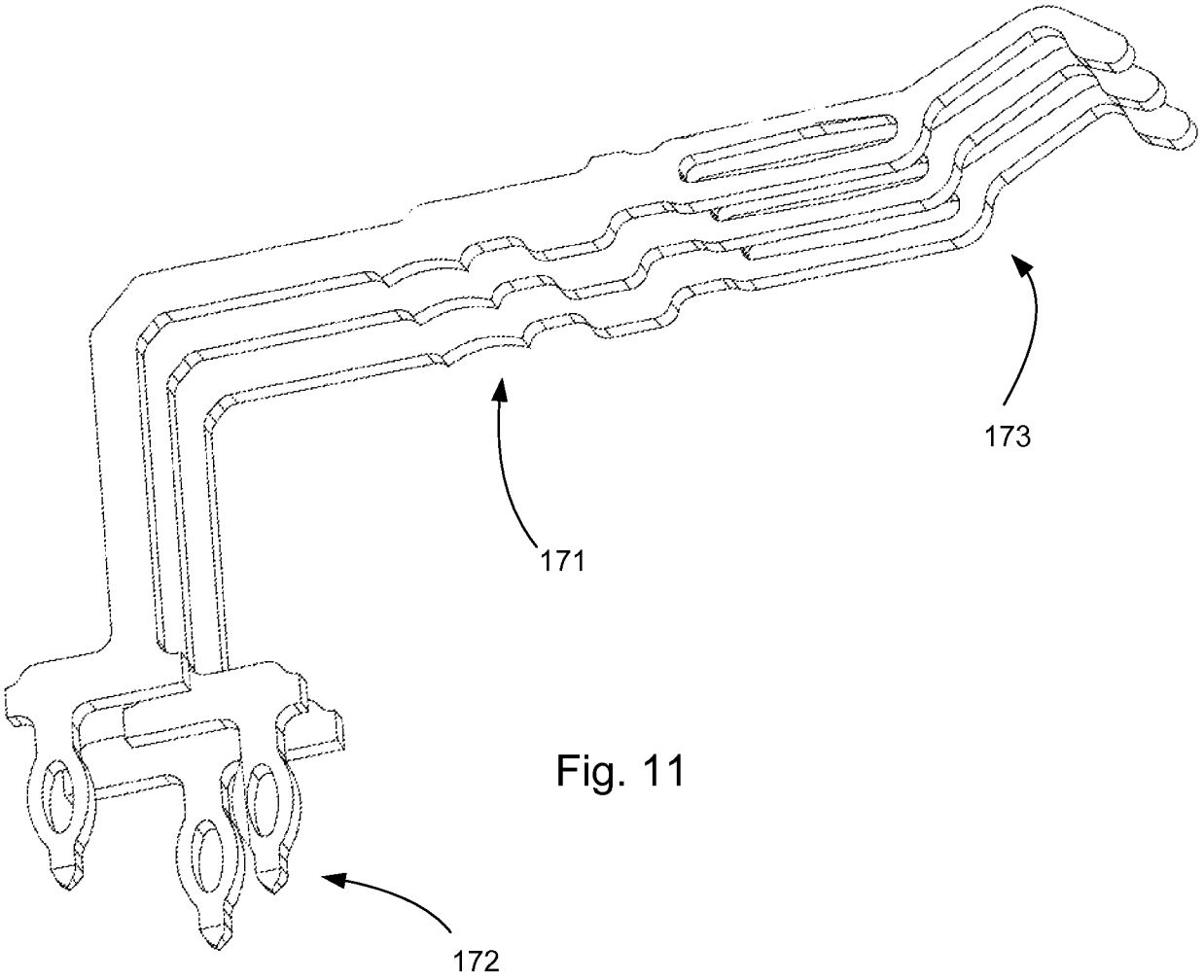
FIG. 11 illustrates another perspective view of the embodiment depicted in FIG. 10.
Figure 12:
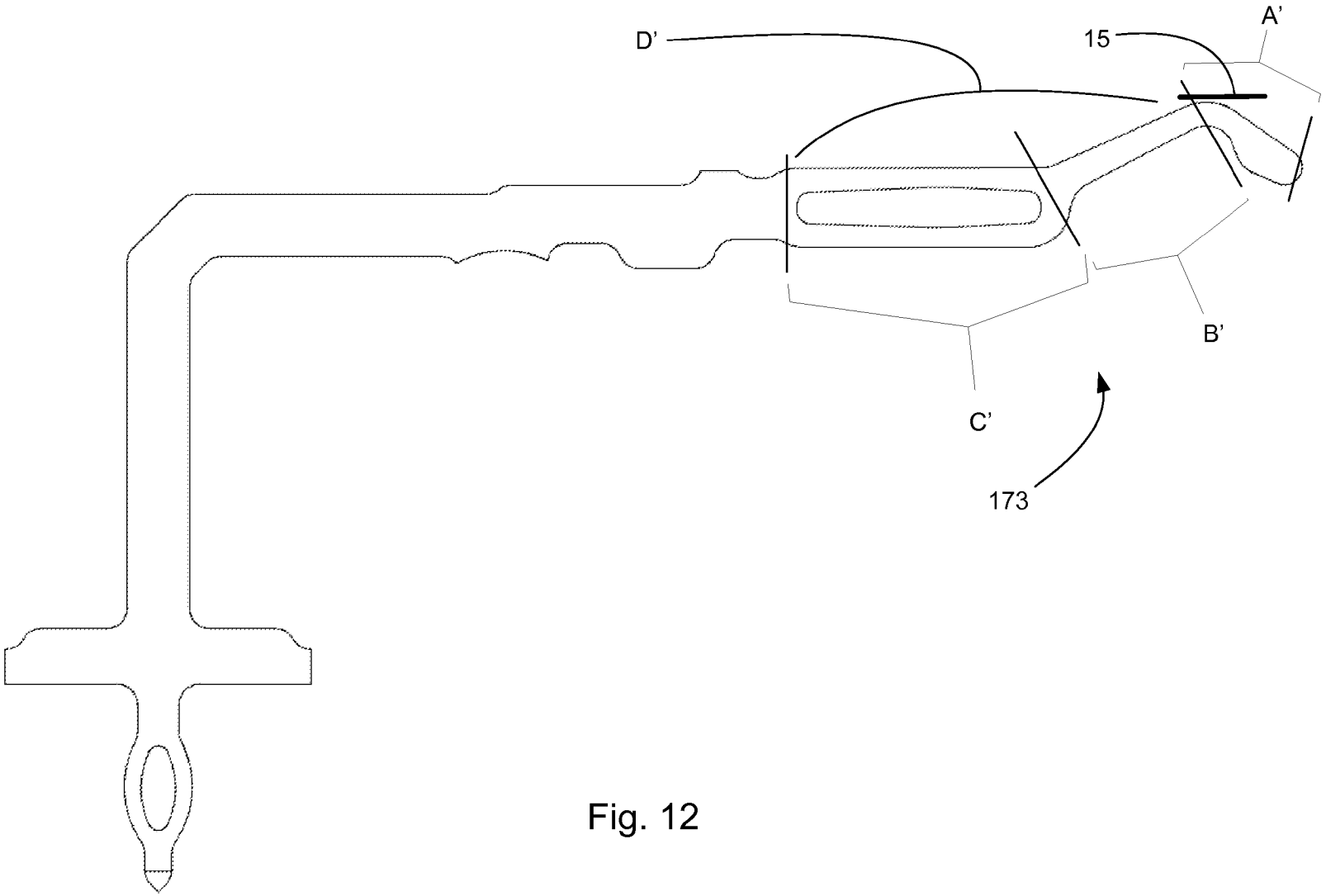
FIG. 12 illustrates an elevated side view of the embodiment depicted in FIG. 10.

FIG. 19 illustrates a prior art terminal 60 configuration that is formed by stamping out the terminal. As is known, the terminal 60 includes a body 71 that connects a tail 72 to a contact 73. The contact 73 includes a deflection portion B and a pad interface portion A. As is known, from a measurement standpoint the pad interface portion A is capacitive (thus causing a dip in the impedance of the terminal), due in part to the size of pad 15, but it is difficult to decrease the size of the pad 15 due to tolerance stack-ups inherent in the connector design. In addition, adjusting the pad interface portion A is difficult due to the need to provide resistance to stubbing. The tail 72 (which can vary in position from terminal to adjacent terminal as can be appreciated from the tails 172*a*, 172*b*, 172*c* of FIG. 6) may also measure as being slightly capacitive but given the constraints of via sizes in a supporting circuit board it becomes difficult to significantly modify the tails without substantially increasing the complexity of the supporting circuit board. The body 71 can readily be tuned for the desired impedance by varying the thickness and the dielectric channel that extends along the terminal. The deflection portion B, however, experiences a substantial inductive increase due to the length and size of the deflection portion B that causes an impedance spike. It has been determined that this impedance spike makes it difficult for a connector system to support higher data rates. In evaluating the shape of the deflection portion B it has proven difficult to modify it as material properties dictate the shape if the deflection portion B is going to provide the desired beam properties (such as resistance to set and contact force). While other more complex terminal construction (such as a blanked and formed construction) offer further improvements in performance, such an alternative construction is more complex and more expensive as it takes more tooling, takes additional steps and thus takes longer to make. Therefore it is desirable to use stamped terminals when possible. Consequentially, it has been determined that stamped terminals using known configurations are problematic when trying to support higher levels of performance.

Figure 2A:
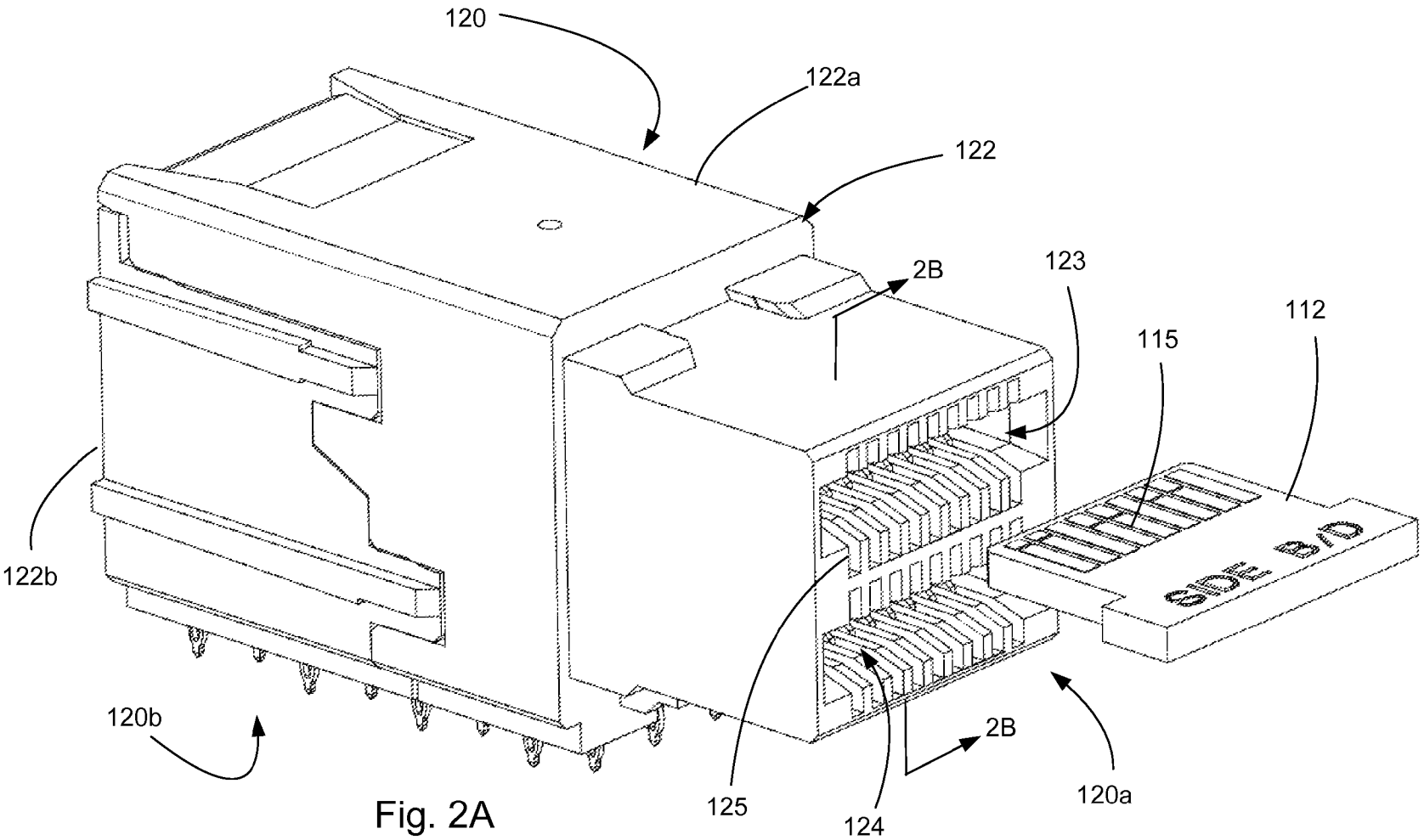
FIG. 2A illustrates a perspective view of an embodiment of a housing with two card slots.

FIG. 2A depicts a connector 120 with a mating face 120*a* and a mounting face 120*b* and the connector 120 includes a housing 122. Thus the connector 120 is configured to be mounted on a circuit board (not shown). While it is common for a connector with female terminals as depicted herein to be mounted on a circuit board it should be noted that such use in not required and in alternative embodiments the terminals used in the connector could also be used in a plug connector. In such an embodiment the terminal could still be configured to be terminated to a circuit board (which would typically be a paddle card) or it could be configured to be terminated directly to a conductive member such as a cable. Thus the depicted embodiments are not intended to be limiting unless otherwise noted.

As depicted, the housing 122 includes a front portion 122*a* and a rear portion 122*b* so as to allow for ease of assembly and for structural reasons but one piece housings are also suitable. The depicted housing 120 includes two card slots 123 and 124 that each have a plurality of terminal grooves 125. In operation, a plug (not shown) with the appropriate number of paddle cards 112 that include pads 115 that are configured to mate with the terminals would be mated with the connector 120 so that an electrical connection could be provided. As can be appreciated, while the connector 120 is in a right angle configuration it should be understood that any desirable housing configuration can be provided, including angled and vertical configurations, and thus the depicted configuration is not intended to be limiting. In addition, while two card slots 123, 124 are depicted, the terminals depicted herein are also suitable for connectors with some other number of card slots such as one or three or more card slots. Furthermore, it should be noted that the depicted terminals are primarily used for signal channels configured to high data rates. For certain connectors it may be suitable to use conventional terminal for some of the terminals that are intended to operate at lower data rates and to only use the improved terminals for the channels that benefit from the improved impedance profile.

Figure 2B:
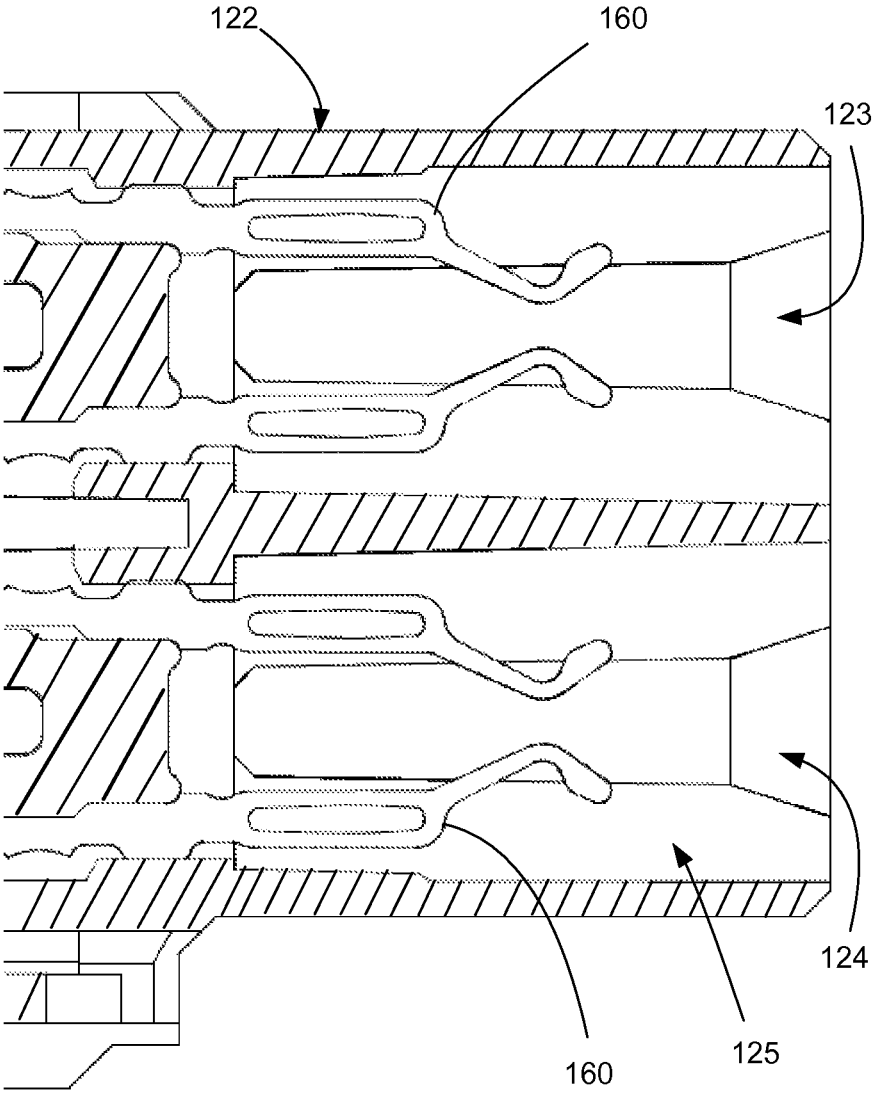
FIG. 2B illustrates an elevated side view of a cross-section of the embodiment depicted in FIG. 2A, taken along line 2B-2B.
Figure 3:
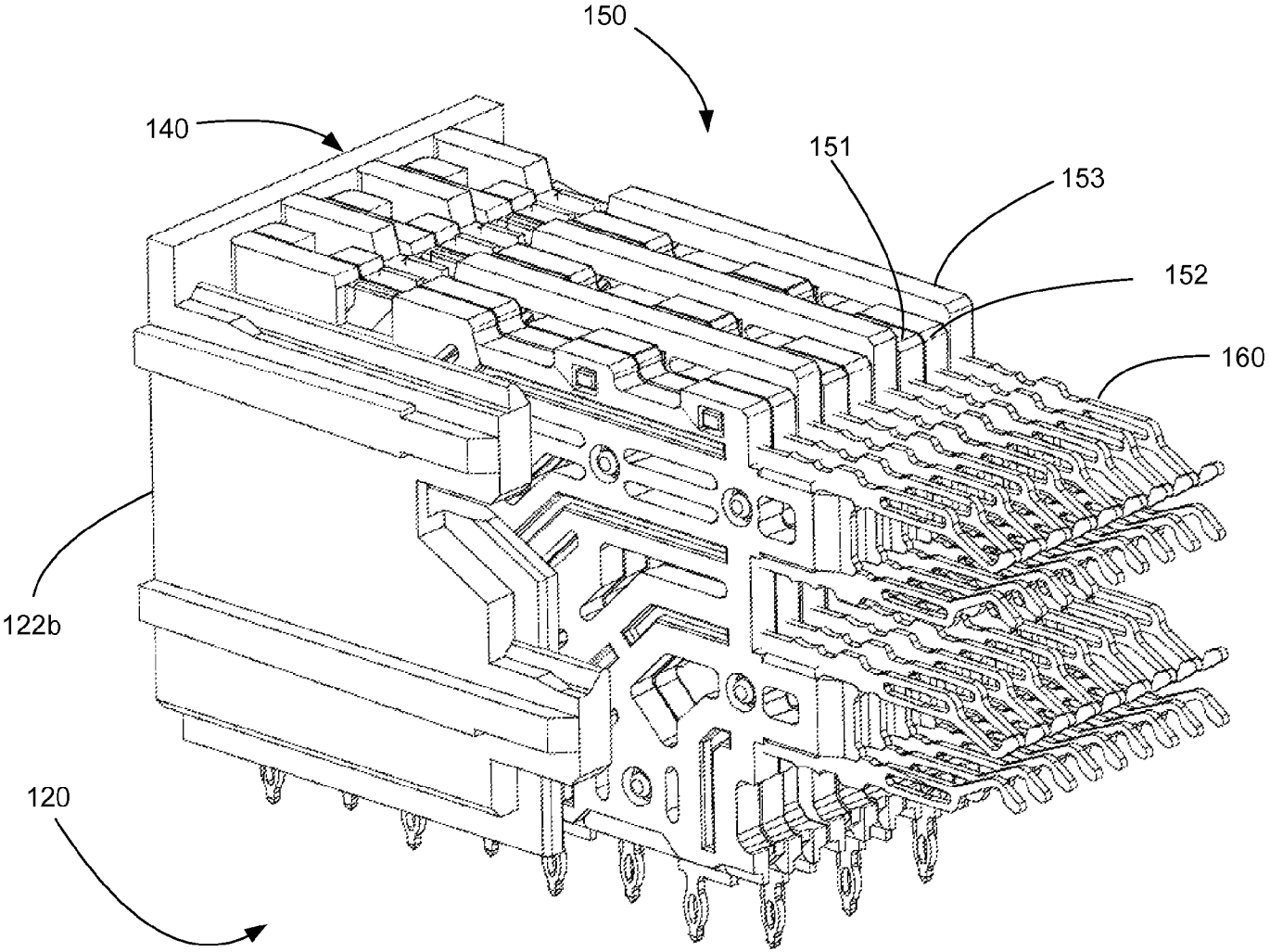
FIG. 3 illustrates a perspective partial view of the embodiment depicted in FIG. 2A.
Figure 4:
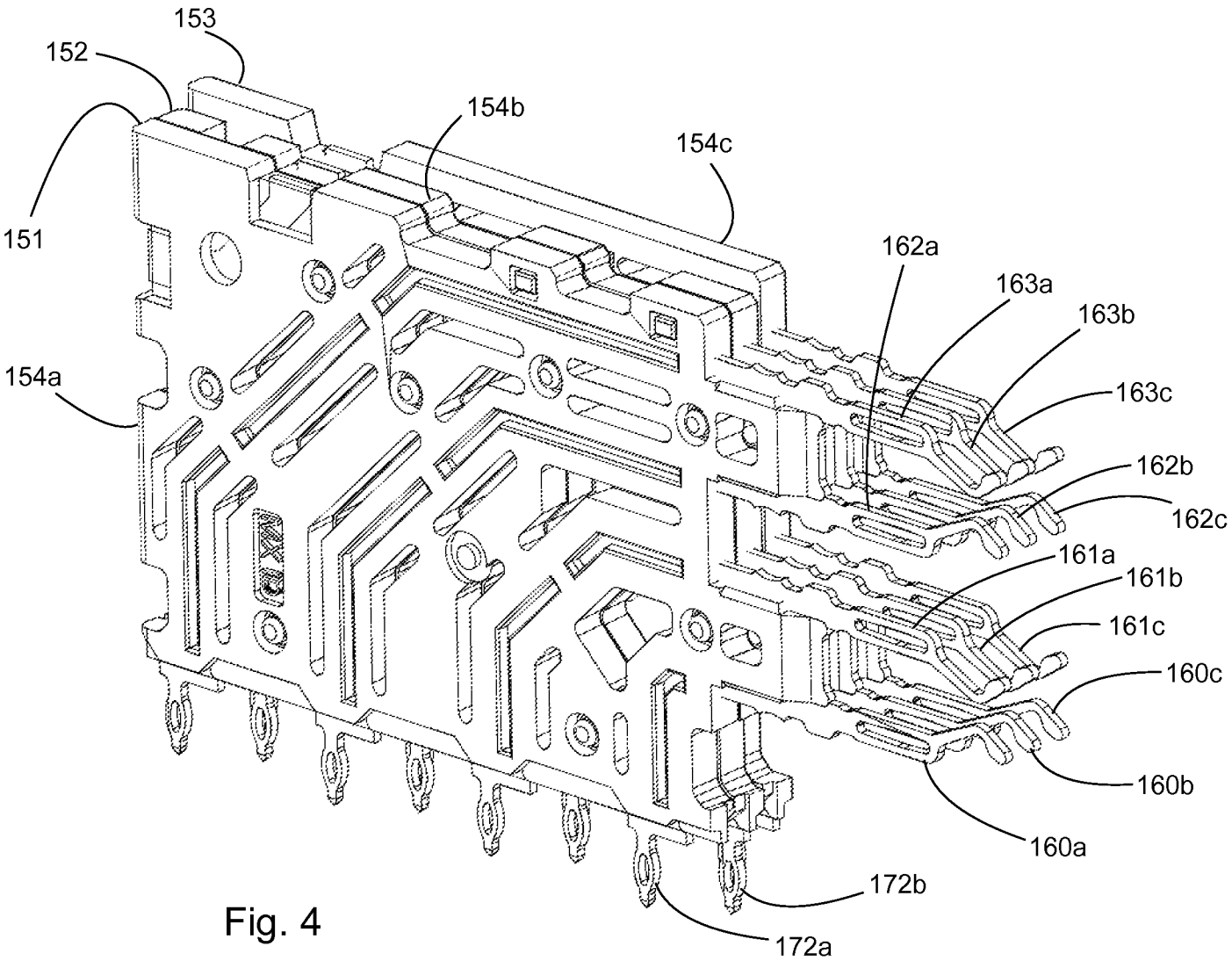
FIG. 4 illustrates a perspective view of an embodiment of three wafers supporting a plurality of terminals.
Figure 5:
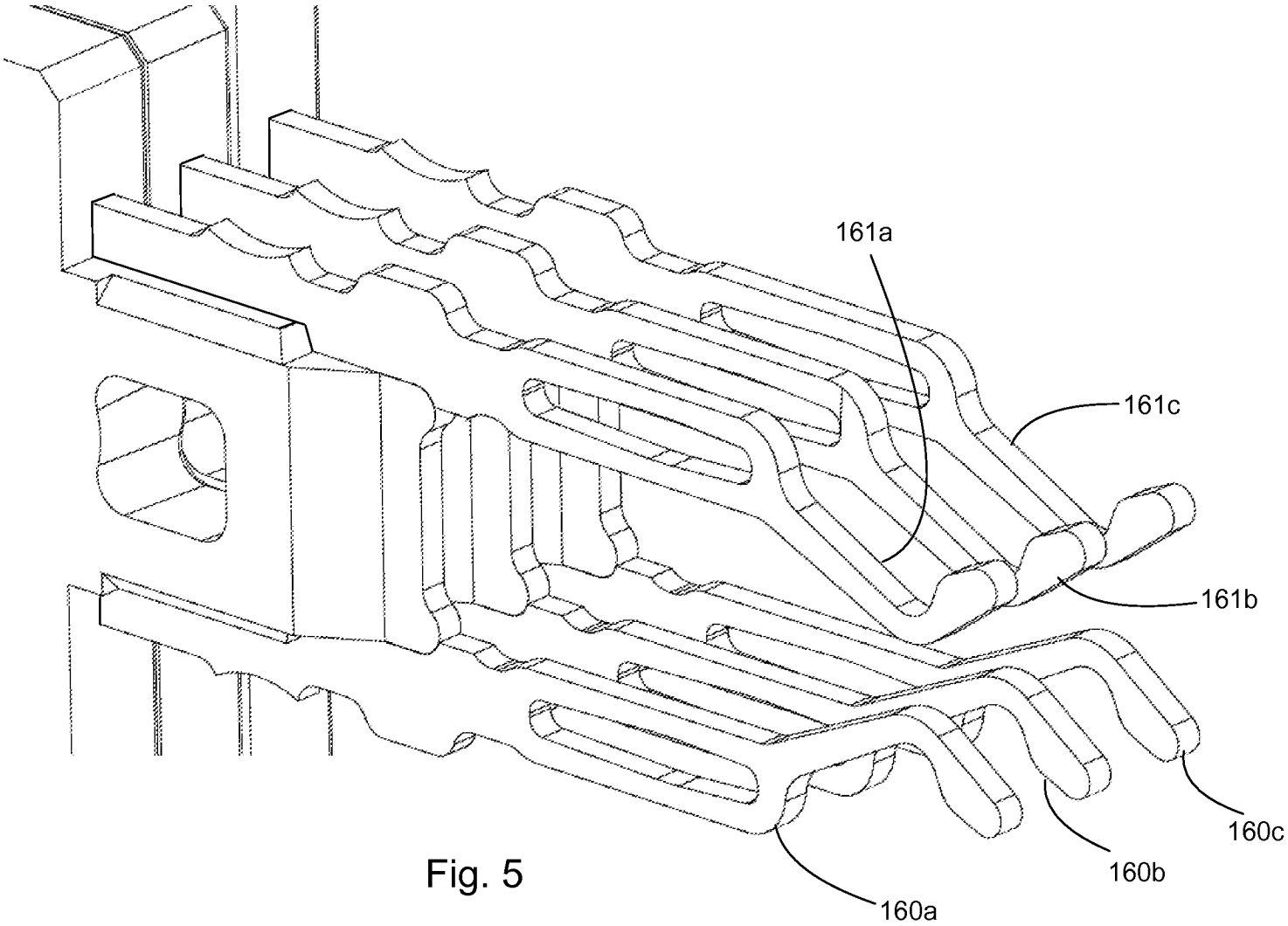
FIG. 5 illustrates an enlarged perspective view of three terminals supported by the wafers depicted in FIG. 4.

FIG. 2B illustrates a cross section of the connector 120 taken along line 2B-2B and the card slots 123, 124 include terminals 160. As can appreciated from the Figs., terminals 160 are provided on opposing sides of each card slot and are positioned in terminal grooves 125. Specifically, the terminals are arranged so that the contacts are in four rows R1-R4 and each row can include at least one set 160-163 of terminals (the set being two signal terminals and one ground terminal).

Figure 1B:
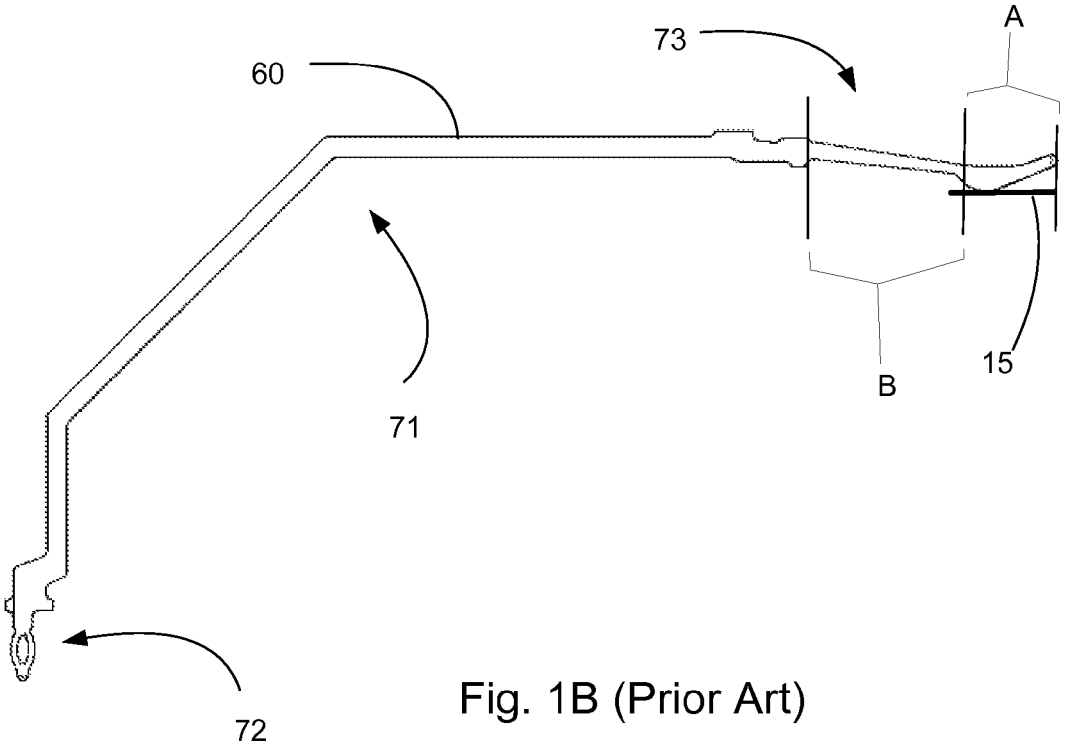
Fig. 1B (Prior Art)
FIG. 1B illustrates a prior art terminal configuration suitable for use in the housing depicted in FIG. 1.

As can be appreciated from a review of the Figs., the housing, which has a rear wall 140, supports a wafer set 150 that includes signal wafers 151, 152 and ground wafer 153 and the wafers support terminals 160 with a frame 154*a*, 154*b*, 154*c*, respectively. More specifically, wafer 151 includes terminals 160*a*, 161*a*, 162*a* and 162*a* while wafer 152 includes terminals 160*b*, 161*b*, 162*b* and 162*b* and while wafer 153 includes terminals 160*c*, 161*c*, 162*c* and 163*c*. Unlike the prior art terminal of FIG. 1B, the depicted terminals 160*a*-160*c*, 161*a*-161*c*, 162*a*-162*c* and 163*a*-163*c* generally include a tail 172, a body 171 and a contact 173 that has a deflection portion D' and a pad interface A' but the deflection portion D' includes a dual-beam portion C' and a single-beam portion B'. The deflection portion D' extends from the housing in a cantilevered fashion and allows the pad interface portion A' to translate when the terminal mates to the corresponding mating connector. The single-beam portion B' is shortened and reduces the inductive nature of the deflecting portion D' (as compared to the deflective portion B of the terminal depicted in FIG. 1B) and therefore reduces the impedance spike that is customarily provided by a convention terminal such as is depicted in FIG. 2. The dual-beam portion C' can be tuned so that it is slightly capacitive, compared to the body of the terminal, and thus helps to further balance out the deflection portion D'. In particular, it has been determined that having a short length of the terminal being slightly capacitive adjacent another short length that is slightly inductive tends to cause the two lengths to balance each other out and thus improves the performance of the combined length. More will be said about this below.

As depicted, the tails 172*a*-172*c* of the respective wafers 151-153 are each offset from each other so as to improve performance in the footprint (which is expected to reduce insertion loss as well as return loss). Alternatively the tails could have a different configuration (for example they could be SMT style tails). SMT style tails tend to performance better than press fit tails but are difficult and undesirable to use in a stacked connector configuration as many of the tails will be soldered blindly.

As can be appreciated, the terminals can be provided so that the terminals have their contacts arranged in rows and with a connector that includes more than one card slot, a separate row of contacts can be provided on each side of each card slot. For example, the depicted connector configuration provides four rows R1-R4 of contacts.

Figure 13:
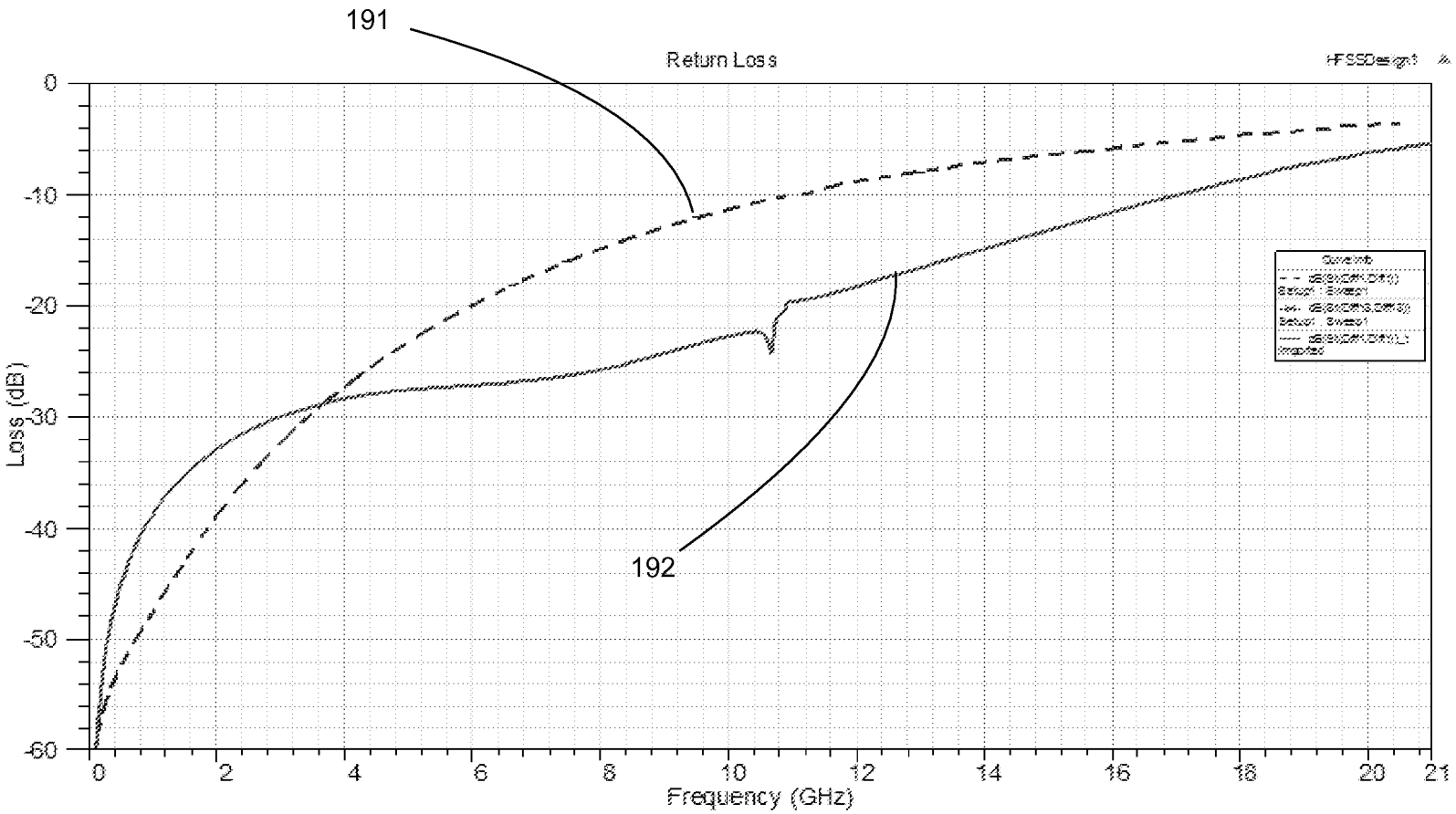
FIG. 13 illustrates a graph that depicts return loss of with an existing and new contact system.
Figure 14:
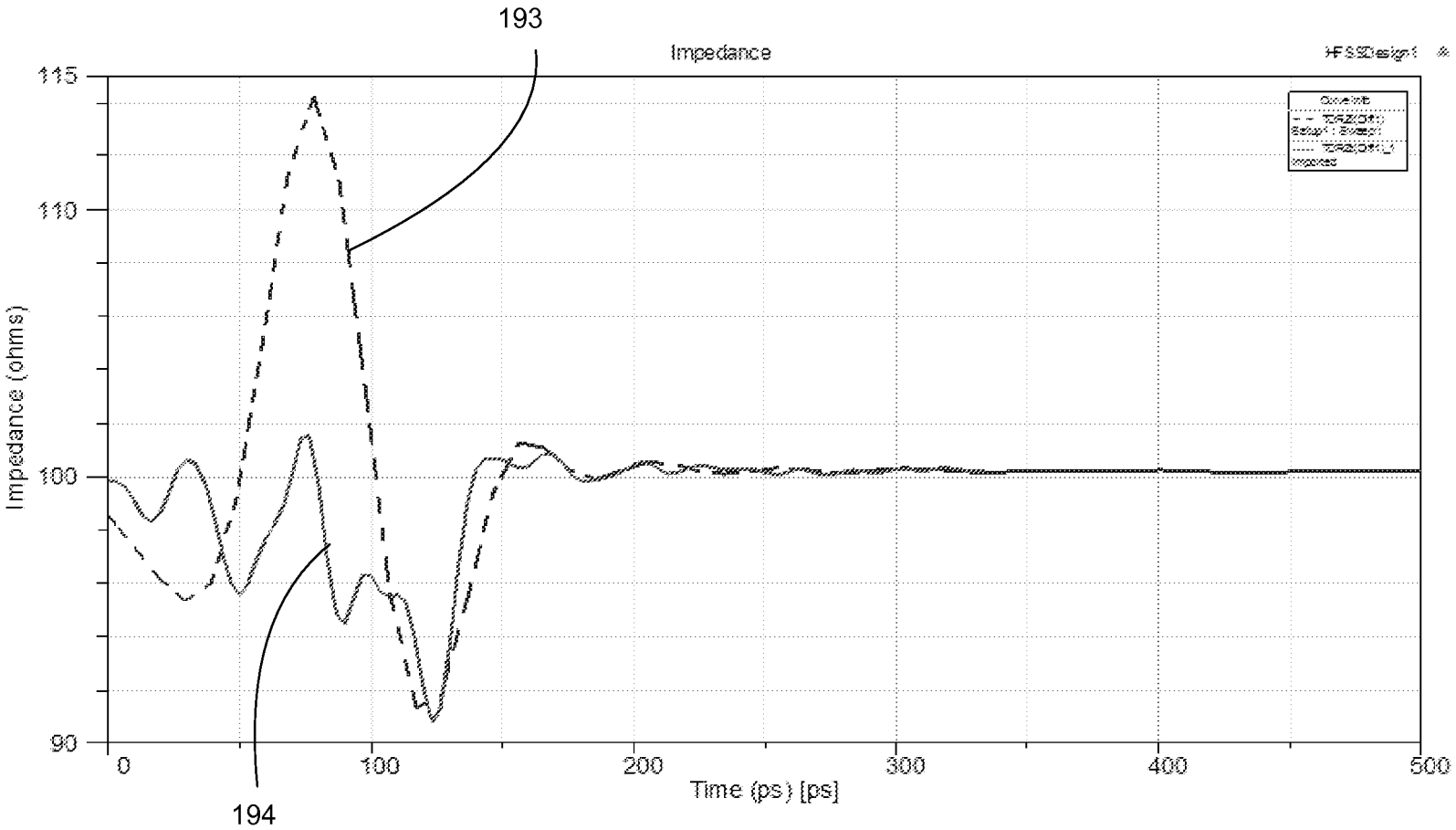
FIG. 14 illustrates a graph that depicts an impedance plot of an existing and new contact system.

As can be appreciated from FIGS. 13-14, which illustrates the performance of the contact portion of the terminal based on computer-based testing, the performance of a differential pair with the improved contact (with a comparable ground terminal on both sides of the differential pair) is illustrated by line 192 and line 194, and offers lower return loss at higher frequencies compared to the performance of the conventional contact system (the performance of which is shown in line 191 and line 193). FIG. 13 shows a substantial improvement in return loss (over 8 dB improvement) at 12 GHz. The impedance at 48 pS rise time is shown in FIG. 14 and as can be readily appreciated, the results of the contact with both the dual and single beams, shown by line 194, allows for a terminal that has an impedance spike that is less than 5 ohms over the targeted 100 ohms (a dip in impedance, while not desirable, tend to be less problematic from a performance standpoint and thus the depicted dips are within an acceptable range for both the improved and the old terminal designs).

Figure 15:
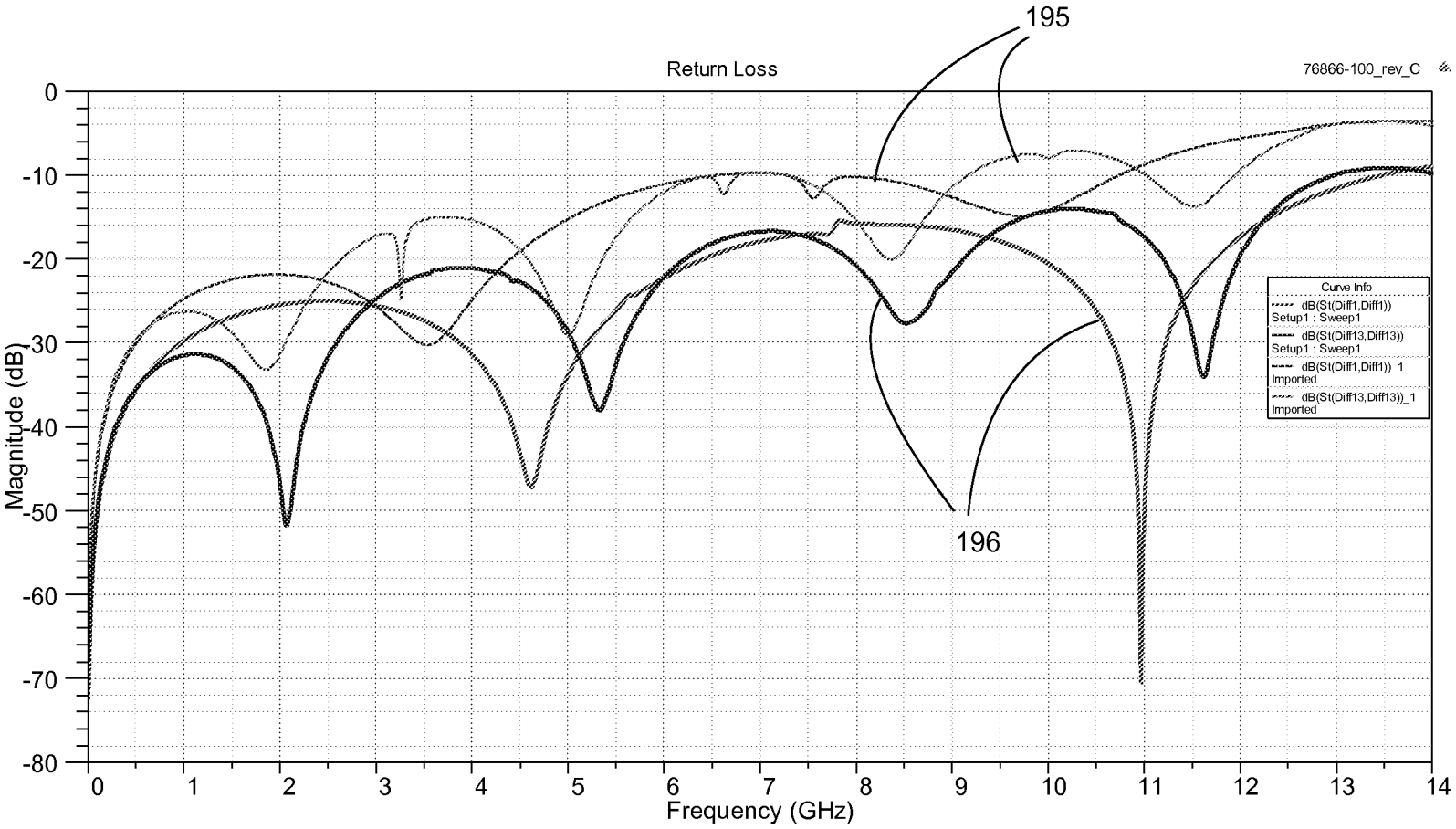
FIG. 15 illustrates a graph that depicts a plot of return loss in an existing and new contact system.

The performance of the connector 120 is illustrated in FIG. 15 with both traditional and improved contacts. Line 195*a* illustrates the return loss of the short pair of the connector 120 with a conventional contact while line 195*b* illustrates the return loss of a long pair with a convention contact (for a stacked connector such as connector 120, the short and long pair reflect the expected envelope of performance for the connector). Lines 196*a*, 196*b* illustrate the return loss of short and long pair with the improved contact. As can be appreciated, the improved contact design, along with some other minor tweaks that don't significantly adjust the performance of the terminal, results in a channel with a return loss at a level such that that the connector retains at least 14 dB of the signal out to 12 GHz after return loss is subtracted, compared to a terminal with a convention beam that would have less than 8 dB of signal at 10 GHz and less than 6 dB of signal at 12 GHz after return loss was subtracted. As can be appreciated, if the return loss results in only 6 dB of signal then the connector is generally considered not suitable for use in real world applications (indeed, in certain applications even 10 dB of signal is considered marginal). Thus, as it is desirable to provide 10 dB of signal out to the signaling frequency after return loss is subtracted, the connector with the improved contact (illustrates by lines 196*a*, 196*b*) would provide suitable performance out to 12 GHz (and perhaps 12.5 GHz, depending on insertion loss which will be discussed below). For a system using NRZ encoding, 12 GHz provides about 2.4 Gbps of bandwidth. Thus, the depicted system allows for a connector system that supports a 24 Gbps data rate. Specifically the terminals retain 10 dB of signal at 12 GHz after return loss is subtracted (indeed, they retain 14 dB of signal).

It should be noted that insertion loss would also typically be subtracted from the usable signal and the insertion loss is expected to be less than 3 dB out to 12 GHz. Thus the depicted testing illustrates a connector with a stamped terminal that can support a 12 GHz signaling frequency or 2.4 Gbps using NRZ encoding.

It should be noted that the depicted configuration has the dual beam portion C' with a first length that is greater than a second length of the single beam portion B'. While not required, it has been determined that such a construction provides further benefits for higher signaling frequencies. Thus it is generally desirable that a length of C' be greater than a length of B'.

As noted above, the contact configuration depicted herein can be used to a wide range of terminal configurations, including press fit style terminals and SMT style terminals. In addition, a connector can be configured so that at least one row of terminals have the improved contact (with the combination dual beam/single beam configuration). Furthermore, if desired the terminals can be different along the row such that only the signal terminals and the adjacent ground terminal are so configured. However, as the improved construction is amendable to being stamped it is expected that it would be reasonably cost effective (even if not required) to have all the terminals with the improved contact configuration.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a housing with a card slot, the card slot including a first side with terminal grooves; and a pair of terminals that are stamped, the terminals supported by the housing, each of the terminals including a tail, a contact positioned in the terminal groove and a body extending between the tail and the contact, wherein the contact of each of the terminals in the pair of terminals includes a deflecting portion and a pad interface portion and the deflecting portion includes a dual beam portion and a single beam portion wherein the dual beam portion has a first length and the single beam portion has a second length that is less than the first length.

2. The connector of claim 1, wherein the card slot includes terminal grooves positioned on both sides of the card slot and the pair of terminals is a first pair of terminals, wherein the card slot has a second side with terminal grooves and the connector further comprises a second pair of terminals positioned in the terminal grooves on the second side, wherein each terminal of the second pair of terminals includes a contact includes a deflecting portion and a pad interface portion and the deflecting portion includes a dual beam portion and a single beam portion.

3. The connector of claims 2, wherein the single beam portion is between the dual beam portion and the pad interface portion.

4. A connector, comprising:

a housing with a card slot, the card slot including a first side with terminal grooves; and a pair of terminals that are stamped, the terminals supported by the housing, each of the terminals including a tail, a contact positioned in the terminal groove and a body extending between the tail and the contact, wherein the contact of each of the terminals in the pair of terminals includes a deflecting portion and a pad interface portion and the deflecting portion includes a dual beam portion and a single beam portion, wherein the pair of terminals are configured to support 12 GHz signaling such that after subtracting return loss at 12 GHz there is 10 dB of signal remaining.

5. The connector of claim 4, wherein after subtracting return loss at 12 GHz there is 14 dB of signal remaining.

6. A connector, comprising:

a housing having a card slot;

a first wafer supported by the housing and having a first signal terminal, the first signal terminal having a tail, a contact and a body extending therebetween, the contact of the first signal terminal having a deflection portion and a pad interface portion at a distal end of the first signal terminal, the deflection portion of the first signal terminal including a dual-beam portion and a single beam portion;

a second wafer supported by the housing and having a second signal terminal, the second signal terminal having a tail, a contact and a body extending therebetween, the contact of the second signal terminal having a deflection portion and a pad interface portion at a distal end of the second signal terminal, the deflection portion of the second signal terminal including a dual-beam portion and a single beam portion; and a third wafer supported by the housing and having a third terminal, the third terminal having a tail, a contact and a body extending therebetween, the contact of the third terminal having a deflection portion and a pad interface portion at a distal end of the third terminal, the deflection portion of the third terminal including a dual-beam portion and a single beam portion, wherein the first and second signal terminals and the third terminal are arranged so that their respective contacts are in a row on one side of the card slot, wherein the deflection portion of each terminal is configured to provide, relative to the impedance of the body, an increase in impedance in the single beam portion and a decrease in impedance in the dual-beam configuration.

7. The connector of claim 6, wherein each wafer supports two terminals, the two terminals of each wafer having contacts that are configured to deflect in the opposite direction and are positioned on opposite sides of the card slot.

8. The connector of claim 7, wherein the first and second wafer each support two signal terminals.

9. The connector of claims 6, wherein the dual-beam portion is adjacent the body and the single beam portion is adjacent the pad interface portion.

10. A connector, comprising:

a housing having a card slot;

a first wafer supported by the housing and having a first signal terminal, the first signal terminal having a tail, a contact and a body extending therebetween, the contact of the first signal terminal having a deflection portion and a pad interface portion at a distal end of the first signal terminal, the deflection portion of the first signal terminal including a dual-beam portion and a single beam portion;

a second wafer supported by the housing and having a second signal terminal, the second signal terminal having a tail, a contact and a body extending therebetween, the contact of the second signal terminal having a deflection portion and a pad interface portion at a distal end of the second signal terminal, the deflection portion of the second signal terminal including a dual-beam portion and a single beam portion; and a third wafer supported by the housing and having a third terminal, the third terminal having a tail, a contact and a body extending therebetween, the contact of the third terminal having a deflection portion and a pad interface portion at a distal end of the third terminal, the deflection portion of the third terminal including a dual-beam portion and a single beam portion, wherein the first and second signal terminals and the third terminal are arranged so that their respective contacts are in a row on one side of the card slot, wherein the dual beam portion has a first length and the single beam portion has a second length that is less than the first length.

* * * * *